US007040199B2

(12) United States Patent
Gregory

(10) Patent No.: US 7,040,199 B2
(45) Date of Patent: May 9, 2006

(54) PIPE WRENCH RETROFIT

(75) Inventor: N. Scott Gregory, 1108 W. Pierce, Carlsbad, NM (US) 88220

(73) Assignee: N. Scott Gregory, Carlsbad, NM (US)

( * ) Notice: Subject to any disclaimer, the term of this patent is extended or adjusted under 35 U.S.C. 154(b) by 33 days.

(21) Appl. No.: 10/669,165

(22) Filed: Sep. 23, 2003

(65) Prior Publication Data

US 2004/0129115 A1 Jul. 8, 2004

Related U.S. Application Data

(60) Provisional application No. 60/413,929, filed on Sep. 26, 2002.

(51) Int. Cl.
*B25B 13/16* (2006.01)

(52) U.S. Cl. ..... 81/159; 81/167; 81/165

(58) Field of Classification Search ..... 81/159, 81/165, 167; 411/427, 431, 437
See application file for complete search history.

(56) References Cited

U.S. PATENT DOCUMENTS

| | | | | |
|---|---|---|---|---|
| 1,301,958 | A * | 4/1919 | Mendenhall | 411/427 |
| 2,345,650 | A * | 4/1944 | Attwood | 411/427 |
| 2,597,403 | A | 5/1952 | Tedesco | |
| 2,704,478 | A | 3/1955 | Webb | |
| 3,636,800 | A | 1/1972 | Myers | |
| 3,996,820 | A | 12/1976 | Tuell | |
| 4,144,779 | A | 3/1979 | Honick | |
| 4,222,310 | A * | 9/1980 | Garrett et al. | 411/437 |
| 4,309,924 | A | 1/1982 | McLain | |
| 4,315,393 | A * | 2/1982 | Schack et al. | 411/427 |
| 4,903,555 | A | 2/1990 | Howard | |
| 5,516,247 | A * | 5/1996 | Hosoda et al. | 411/427 |
| 5,749,690 | A * | 5/1998 | Kutz | 411/431 |
| 5,810,532 | A * | 9/1998 | Huang | 411/431 |

* cited by examiner

*Primary Examiner*—Lee D. Wilson
(74) *Attorney, Agent, or Firm*—Conley Rose, P.C.

(57) ABSTRACT

The specification discloses a modified nut assembly and locking assembly for locking the shank of a wrench in place. The nut assembly preferably includes a nut for engaging and disengaging the shank of the wrench and a spring for biasing the nut to a position where the shank of the wrench is locked in place. Threads internal to the nut matingly engage threads on the shank of the wrench when in a locked position, and grooves internal to the nut allow the shank of the wrench to slide freely through the nut when in an unlocked position. The locking assembly preferably includes a housing, a sliding portion, a locking portion, and a spring. The sliding portion and locking portion preferably abut each other within the housing. The spring is preferably located in the sliding portion and extends from the sliding portion to the shank of the wrench.

2 Claims, 4 Drawing Sheets

PIPE WRENCH RETROFIT

CROSS-REFERENCE TO RELATED APPLICATIONS

This application claims the benefit of provisional application Ser. No. 60/413,929 filed on Sep. 26, 2002, which is incorporated by reference herein as if reproduced in full below.

STATEMENT REGARDING FEDERALLY SPONSORED RESEARCH OR DEVELOPMENT

Not Applicable.

BACKGROUND OF THE INVENTION

1. Field of the Invention

The present invention relates to an adjustable pipe wrench. More precisely, the present invention relates to a modified nut assembly and locking assembly for use on an adjustable pipe wrench.

2. Background of Relevant Art

Conventionally, when securing a pipe wrench to a pipe or rod, a nut that is capable of adjusting the size of the mouth of the pipe wrench is turned so that the mouth of the wrench is opened large enough to receive the pipe or rod. The pipe or rod is inserted into the mouth of the wrench, and then, the mouth of the pipe wrench is tightened to the pipe or rod by turning the nut in the reverse direction. A problem realized by this arrangement is that the nut must be turned a number of times in order to reach the desired position.

Thus, what is needed in the art is a pipe wrench, and related mechanism, that overcomes the deficiencies of the related art.

BRIEF SUMMARY OF SOME OF THE PREFERRED EMBODIMENTS

The present invention overcomes the deficiencies of the prior art by providing a modified nut assembly and locking assembly. In an embodiment of the present invention, a nut assembly for use on a wrench includes a nut for engaging and disengaging the shank of the wrench and a spring for biasing the nut to a position where the shank of the wrench is locked in place. Threads internal to the nut matingly engage threads on the shank of the wrench when in a locked position, and grooves internal to the nut allow the shank of the wrench to slide freely through the nut when in an unlocked position.

In another embodiment, a locking assembly for use on a wrench includes a housing, a sliding portion, a locking portion, and a spring. The sliding portion and locking portion preferably abut each other within the housing. The spring is preferably located in the sliding portion and extends from the sliding portion to the shank of the wrench.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

In order to fully describe the embodiments of the present invention, reference will be made throughout this description to threads and straight ridges. A thread is herein defined as a helical or spiral ridge by which parts can be screwed together. Conversely, a straight ridge does not enable parts to be screwed together. It should be appreciated that the scope of the invention is only limited by the claims and not by this description.

Figure 1:
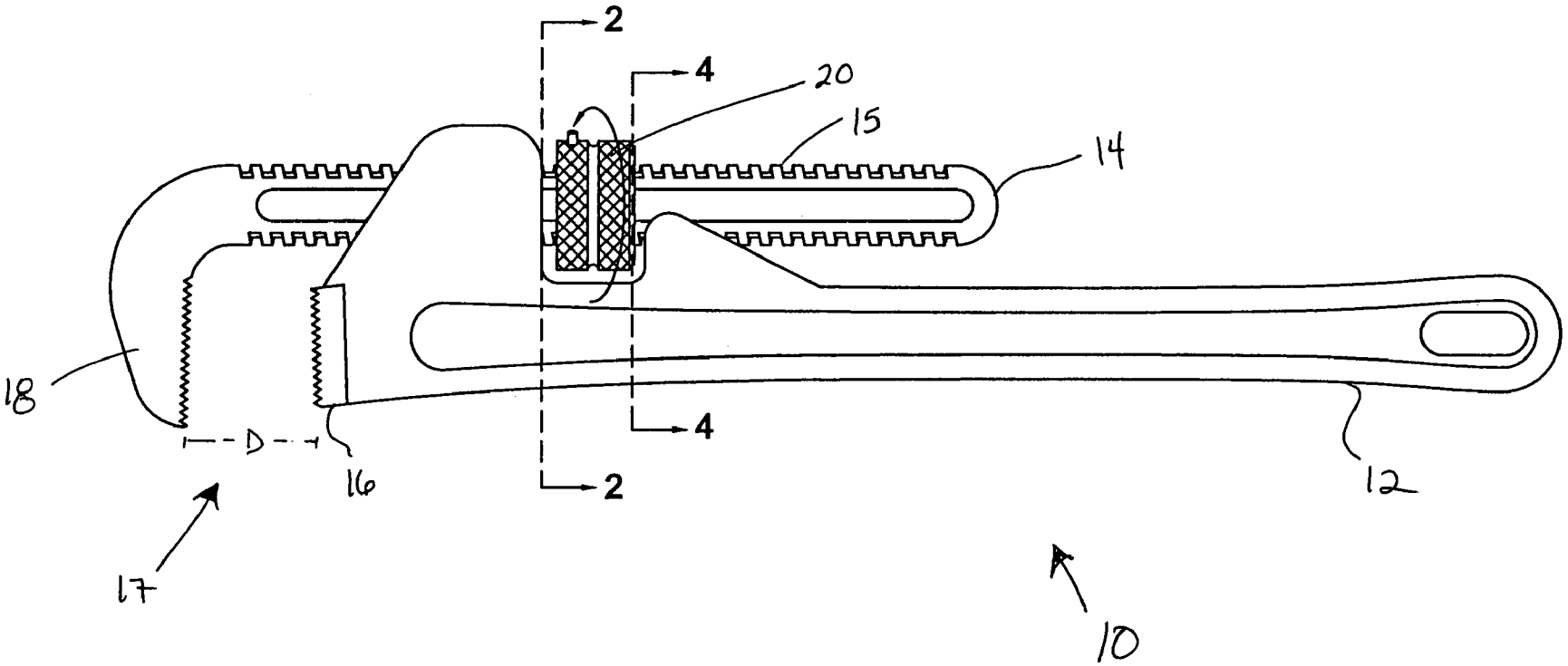
FIG. 1 is side view of a pipe wrench in accordance with an embodiment of the present invention.

Referring initially to FIG. 1, a pipe wrench 10 in accordance with an embodiment of the present invention is shown. Pipe wrench 10 includes a handle 12 and a shank 14. Handle 12 has a fixed jaw portion 16 located at its distal end. Shank 14 has an adjustable jaw portion 18 located opposite fixed jaw portion 16. Fixed jaw portion 16 and an adjustable jaw portion 18 define a jaw 17 having a jaw diameter D. Shank 14 has a series of threads 15 threadingly connected through a nut 20. A spring 24 is wound around nut 20 and terminates on handle 12.

As described above, in order to change the jaw diameter D in conventional wrenches, a user must turn the nut in complete revolutions. For large pipe wrenches, it takes significant time, and several revolutions of the nut, to adjust significant changes in the jaw diameter D. The embodiments of the present invention, in a broad sense, address the adjustment time problem by allowing the shank 14 to decouple from threads 21 on the internal diameter of the nut 20, thus allowing the shank 14 to simply slide within the nut 20. The spring 24 acts to bias the nut 20 to engage threads 15 of the shank 14.

Figure 2B:
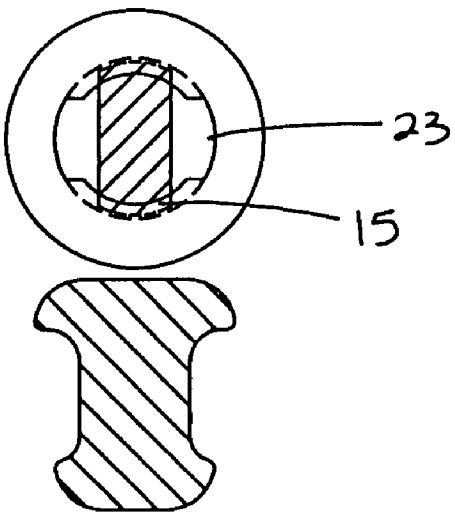
FIG. 2B is a cross-sectional view taken along line 2—2 of FIG. 1 showing the nut in a locked position.
Figure 2A:
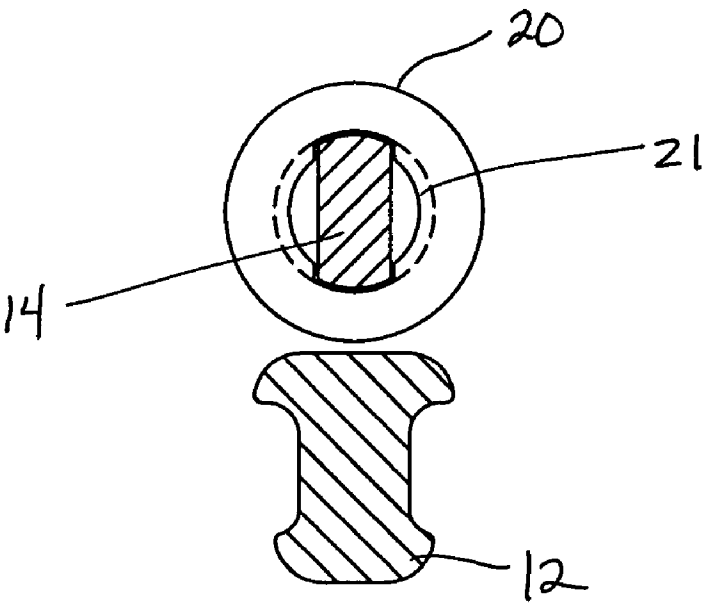
FIG. 2A is a cross-sectional view taken along line 2—2 of FIG. 1 showing the nut in an unlocked position.

FIGS. 2A and 2B, taken substantially along line 2—2 of FIG. 1, show an embodiment for allowing the shank 14 to slide freely within the nut 20, yet being able to lock the shank 14 and adjustable jaw portion 18 into position as desired. In particular, the nut 20 has internal threads 21, similar to conventional nuts; however, a portion of those threads are cut away, forming grooves 23, in such a fashion as to allow the shank 14 to decouple from the threads 21 on the internal diameter of the nut 20. Thus FIG. 2A shows the nut 20 turned to a position where the shank 14 slides freely therethrough grooves 23.

Conversely, FIG. 2B shows the nut 20 turned to such a position that the threads 21 on the internal diameter of the nut 20 are in mating relationship with the corresponding threads 15 of the shank 14. Thus, adjusting the pipe wrench 10 using this embodiment involves turning the nut 20 approximately a quarter turn, which then allows the shank 14 to move freely within the nut 20. Once the appropriate jaw diameter D is achieved, the nut 20 is forced a quarter turn in the opposite direction, as biased by spring 24, which locks the shank 14, and thus the adjustable jaw portion 18, in place. Spring 24 terminates on handle 10, preferably at a location proximate to nut 20.

Figure 4:
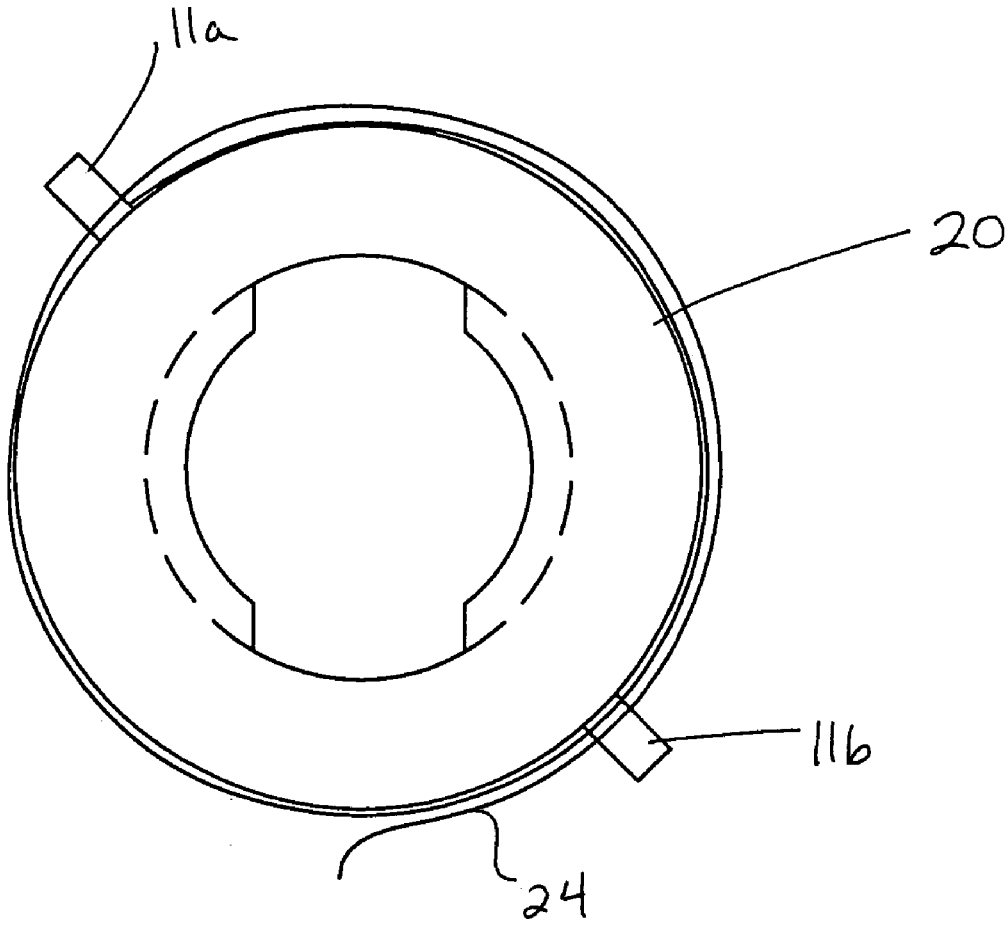
FIG. 4 is a cross-sectional view taken along line 4—4 of FIG. 1 showing the spring wound around the nut.

In some embodiments, a set of stop pins 11 is located on nut 20, to which the spring 24 may be fastened. FIG. 4, taken substantially along line 4—4 of FIG. 1, shows spring 24 originating from stop pin 11*a*. In addition, stop pins 11 provide the user a gripping means and tell the user when the nut 20 is in a locked or unlocked position. In addition, stop pins 11 provide a positive stopping mechanism for nut 20 in both the unlocked position where the shank 14 is allowed to slide, and in the locked position where threads on the shank mate with corresponding threads on the nut 20.

It will be appreciated that the modified nut 20 assembly described above and depicted in FIGS. 1, 2A, 2B, and 4 can be installed in a popular commercial wrench with little effort.

Figure 3B:
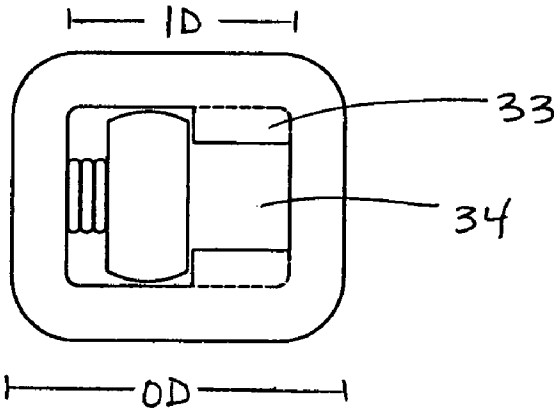
FIG. 3B is a cut-away top view of the locking assembly in an unlocked position.
Figure 3A:
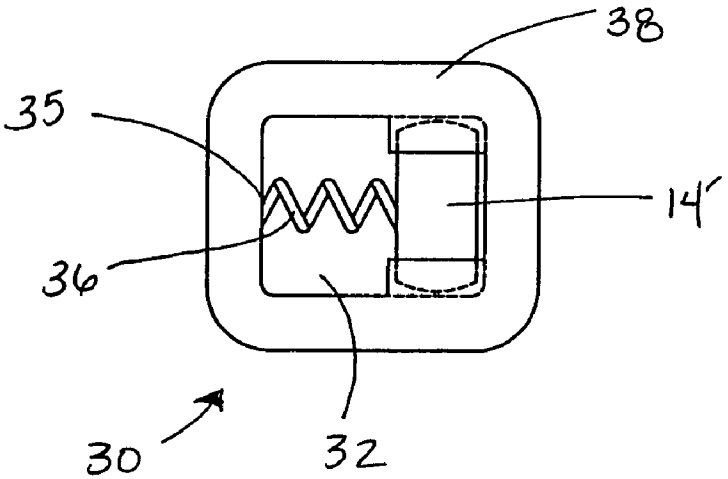
FIG. 3A is a cut-away top view of the locking assembly in a locked position.

FIGS. 3A and 3B show another embodiment for allowing the shank 14 and adjustable jaw portion 18 to move freely during adjustment, yet locking the shank 14 and adjustable jaw portion 18 in place for use of the pipe wrench. In particular, FIG. 3A shows a rectangular actuation member 30 having a sliding portion 32, a locking portion 34, a spring 36, and housing 38. Sliding portion 32 and locking portion 34 abut each other, defining the internal diameter ID of actuation member 30. Housing 38 defines the outer diameter OD of actuation member 30 and contains the sliding portion 32, locking portion 34, and spring 36. Spring 36 is located inside sliding portion 32, and extends from the edge 35 of sliding portion 32 to shank 14.

It will be appreciated that rectangular actuation member 30 is a replacement part for a nut on conventional pipe wrenches. Actuation member 30 is distinguishable over conventional nuts because it has straight ridges 33 on locking portion 34, and not threads. In addition, it will be appreciated that a modified shank 14' having straight ridges (not shown) on its upper and lower surface should be used in combination with rectangular actuation member 30.

FIG. 3A is a cut-away view of the shank 14' in mating relationship with the locking portion 34. The actuation member 30 is held in place in by spring 36, which is expanded. In this embodiment, the default position of the actuation member 30 is in the locked position, whereby the shank 14' is in a mating relationship with the locking portion 34. If a user wishes to adjust the jaw diameter D, the user must apply force to housing 38.

Referring now to FIG. 3B, as described above, applying force to housing 38 forces the actuation member 30 to decouple from the shank portion 14'. The pressure exerted on housing 38 forces actuation member 30 to slide, in one embodiment, to the right. It will be appreciated, however, that a "left-handed" version operates by sliding the actuation member to the left as viewed from the same direction. Subsequently, spring 36 is compressed, which allows the shank 14' to move freely within the sliding portion 32.

As previously described, actuation member 30 described above and depicted in FIGS. 3A and 3B may be used on conventional wrenches in combination with modified shank 14'.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

What is claimed is:

1. A nut assembly for use on a wrench comprising:

a nut having threads that matingly engage a shank of the wrench and grooves that allow the shank of the wrench to slide freely through the nut;

a spring coupled to the nut, wherein the spring is configured to continuously bias the nut toward a matingly engaged relationship with the shank when the nut is arranged to allow the shank to slide freely through the nut; and a set of stop pins located on the exterior of said nut which provide positive stopping mechanism of the nut.

2. The nut assembly according to claim 1 wherein said nut comprises at least two stop pins that are located 180 degrees apart.

* * * * *